US007053857B2

(12) United States Patent
Noro et al.

(10) Patent No.: US 7,053,857 B2
(45) Date of Patent: May 30, 2006

(54) LOOP ANTENNA HAVING BETTER DIRECTIVITY IN LOW RANGE OF ANGLE OF ELEVATION

(75) Inventors: Junichi Noro, Akita (JP); Isao Fukae, Tokyo (JP); Akira Miyoshi, Kanagawa (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 1 day.

(21) Appl. No.: 10/874,908

(22) Filed: Jun. 22, 2004

(65) Prior Publication Data

US 2005/0035922 A1 Feb. 17, 2005

(30) Foreign Application Priority Data

Aug. 11, 2003 (JP) ..... 2003-291084

(51) Int. Cl.
*H01Q 7/00* (2006.01)
*H01Q 11/12* (2006.01)

(52) U.S. Cl. ..... 343/866; 343/741; 343/742

(58) Field of Classification Search ..... 343/866, 343/842, 741, 742, 867
See application file for complete search history.

(56) References Cited

U.S. PATENT DOCUMENTS

| | | | | |
|---|---|---|---|---|
| 6,462,481 | B1 * | 10/2002 | Holland et al. | 315/111.21 |
| 6,738,650 | B1 * | 5/2004 | Zhou et al. | 455/575.5 |
| 2001/0052882 | A1 * | 12/2001 | Noro et al. | 343/895 |
| 2002/0158803 | A1 * | 10/2002 | Hill et al. | 343/702 |
| 2003/0063038 | A1 * | 4/2003 | Nakano et al. | 343/742 |

* cited by examiner

*Primary Examiner*—Trinh Dinh
*Assistant Examiner*—Angela M Lie
(74) *Attorney, Agent, or Firm*—Frishauf, Holtz, Goodman & Chick, P.C.

(57) ABSTRACT

In a loop antenna including a circuit board, a cylindrical body standing on a surface of the circuit board, and a loop antenna element formed on the cylindrical body along the peripheral surface, a tubular insulator member is placed with some space around the cylindrical body. A conductor ring is formed on the tubular insulator member along the peripheral surface, and is placed on an intermediate position between the surface of the circuit board and the plane formed by the loop antenna element. A conductor wall is placed with some space around the cylindrical body on an intermediate distance between the surface of the circuit board and the plane formed by the loop antenna element into height.

7 Claims, 7 Drawing Sheets

| UNIT dBi | PRIOR ART | | EMBODIMENT | | | | | | | |
|---|---|---|---|---|---|---|---|---|---|---|
| | | | 1st | | 2nd | | 3rd | | 4th | |
| | Loop Ant. | | LA + Ring | | LA + R + Pin | | LA + Wall | | LA + R + W | |
| EL. A | R | L | R | L | R | L | R | L | R | L |
| 20 | 2.1 | 2.3 | 2.9 | 3.1 | 2.9 | 2.9 | 3.0 | 3.1 | 3.1 | 3.5 |
| 25 | 2.9 | 2.9 | 3.4 | 3.6 | 3.6 | 3.5 | 3.7 | 3.5 | 3.7 | 4.0 |
| 30 | 2.9 | 2.8 | 2.9 | 3.1 | 3.4 | 3.1 | 3.3 | 3.1 | 3.4 | 3.5 |
| 35 | 2.3 | 2.2 | 1.8 | 2.0 | 2.5 | 2.0 | 2.2 | 2.2 | 2.2 | 2.2 |
| 40 | 2.2 | 2.6 | 1.8 | 2.3 | 2.0 | 1.9 | 1.9 | 2.3 | 1.5 | 2.0 |
| 45 | 3.6 | 4.0 | 3.4 | 3.7 | 3.0 | 3.2 | 3.4 | 3.7 | 2.7 | 3.2 |
| 50 | 4.5 | 4.6 | 3.9 | 3.8 | 3.7 | 3.6 | 4.2 | 3.6 | 3.5 | 3.5 |
| 55 | 3.9 | 3.8 | 2.3 | 2.2 | 3.0 | 2.9 | 2.9 | 2.5 | 2.4 | 2.0 |
| 60 | 3.7 | 3.9 | 2.0 | 2.3 | 2.1 | 2.2 | 2.3 | 2.5 | 1.1 | 1.4 |

Ant.: Antenna LA: Loop Antenna R: Ring W: Wall

LOOP ANTENNA HAVING BETTER DIRECTIVITY IN LOW RANGE OF ANGLE OF ELEVATION

This application claims priority to prior Japanese application JP 2003-291084, the disclosure of which is incorporated herein by reference.

BACKGROUND OF THE INVENTION

This invention relates to a digital radio receiver for receiving an electromagnetic wave from an artificial satellite (that may be called a "satellite wave") or an electromagnetic wave on the ground (that may be called a "terrestrial wave") to listen in a digital radio broadcasting and, in particular, to a loop antenna for mainly use in the digital radio receiver.

In recent years, a digital radio receiver, which receives the satellite wave or the terrestrial wave to listen in the digital radio broadcasting, has been developed and is put to practical use in the United States of America. The digital radio receiver is mounted on a mobile station such as an automobile and can receive an electromagnetic wave having a frequency of about 2 gigahertz (GHz) to listen in a radio broadcasting. That is, the digital radio receiver is a radio receiver which can listen in a mobile broadcasting. In addition, the terrestrial wave is an electromagnetic wave in which a signal where the satellite wave is received in an earth station is frequently shifted a little.

In order to receive such an electromagnetic wave having the frequency of about 2 GHz, it is necessary to set up an antenna outside the automobile. Although a variety of antennas having such various structures as planer-type (plane-type), cylindrical-type or the like have been proposed, the antennas of cylindrical-type are generally used rather than those of planer-type (plane-type). This is because a wider directivity is achieved by forming the antenna into a cylindrical shape.

A loop antenna is known in the art as one of the antennas of the cylindrical-type. The loop antenna has structure where one antenna lead member is wound around a peripheral surface of a hollow or solid cylindrical (which is collectively called "cylindrical") member in a loop fashion, namely, is an antenna having the form of a loop. It is known in the art that the loop antenna acts as an antenna having a directivity in a longitudinal direction of the cylindrical body axis if the antenna lead member has an all around length which is selected to about one wavelength. This is because the antenna lead member has a sinusoidal distribution of a current.

A conventional loop antenna is practically used as the antenna of the digital radio receiver. However, inasmuch as such structure has the directivity for a longitudinal direction to axis of the cylindrical body, it is not possible that the loop antenna sufficiently catches the terrestrial wave nearly in a horizontal plane of a vertical direction to the axis of the cylindrical body.

For example, as Illustrated in FIG. 1, a conventional loop antenna comprises a cylindrical body 11 and a loop antenna element 10. The cylindrical body 11 is formed by rounding a flexible insulator film member around a central axis in a cylindrical fashion. The loop antenna element 10 is made of conductor, and formed on the cylindrical body 11 along the peripheral surface around the central axis in a loop fashion. The loop antenna 1 further comprises four feeders 12 formed on the peripheral surface of the cylindrical body 11 to feed to the loop antenna element 10 at four points. One end in each of the four feeders 12 is directly connected with the loop antenna element 10. The other end in each of the four feeders 12 is connected with an antenna device circuit mounted on a circuit board 13.

That is, the conventional loop antenna 1 of the type described is formed by mounting the cylindrical body 11 with the loop antenna element 10 and four feeders 12 on the circuit board 13 and by connecting and fixing the other end of each of the four feeders 12 with the circuit board 13. Here, the number of feeders is shown as four which is an example and may be settled by any number.

Referring now to FIG. 2, description will be made of antenna radiation characteristic of the loop antenna having the directivity in a longitudinal direction of the cylindrical body axis.

FIG. 2 shows an antenna radiation pattern of LHCP (left-hand circular polarization wave) gains in frequency 2 GHz band in case of measuring the gain of the loop antenna element having following sizes in the shape shown in FIG. 1 and placed on a ground plate. That is, FIG. 2 shows a pattern of the gains for the left-hand and right-hand circular polarization waves in a vertical plane including the central axis of the cylindrical body, setting zero degree of a horizontal plane of the loop antenna element crossing at right angles with the horizontal plane and 90 degree of a top of the axis.

The data shown in FIG. 2 are obtained by following conditions. The cylindrical body with an outside diameter of 20 mm and a height of 20 mm is placed on a center of a surface of a ground plate with a diameter of 1 m, placing commonly a central axis of the cylindrical body and a vertical axis of the ground plate. And the loop antenna element is provided along the peripheral surface around the top of the cylindrical body.

As shown in FIG. 2, in the loop antenna having structure described above, a gain obtained for each angle from −20 degrees to +20 degrees on either side is very small comparing with a gain for an angle of elevation on +20 degrees or more. This means a defect that, on the level surface formed by the loop antenna element, the gain is not good enough obtained from electromagnetic wave arriving within range of the low angle of elevation.

Such a defect is very large obstacle for using the above-described loop antenna to the digital radio receiver loaded onto an automobile. The central axis of the loop antenna loaded onto an automobile is placed to vertical direction of the level surface in order to avoid any fluctuation of receiving level corresponding to change the direction of the automobile. On the other hand, it is sure that electromagnetic waves become weak because of obstacle on the ground for either the satellite wave or the terrestrial wave within the range of low angle of elevation.

Accordingly, the conventional loop antenna is disadvantageous in that the gain needs any increase in the range of low angle of elevation against the level surface.

SUMMARY OF THE INVENTION

It is therefore an object of the present invention to provide a loop antenna which, placing commonly a central axis of the loop antenna and a vertical axis of the horizontal surface, is capable of obtaining the good enough gain within the range of low angle of elevation against a plane formed by the loop antenna element.

A loop antenna of the present invention is mainly characterized by providing a conductor member, in order to attain the above-described object. The conductor member is placed with some space around a cylindrical body having a loop antenna element. Further, the conductor member is placed on a predetermined intermediate position from a surface of a circuit board up to a plane formed by the loop antenna element. It is preferable that the predetermined position is about a middle position. The conductor member may, for example, be a conductor ring, a set of conductor pins, a conductor wall, or the like or a combination of them.

The loop antenna of this invention fundamentally structured stands on the surface of the circuit board and comprises the cylindrical body, the loop antenna element, and the conductor member. The cylindrical body is formed by rounding a flexible insulator member around a central axis in a cylindrical fashion. The loop antenna element is made of conductor, and formed on the cylindrical body along the peripheral surface around the central axis in a loop fashion and onto a plane formed vertically to the central axis in loop fashion.

The conductor ring of the conductor member is long and narrow and formed on a tubular insulator member of ABS resin, for example, along the peripheral surface, with some space around the cylindrical body in a loop fashion. The conductor ring is placed on a middle or intermediate position between the surface of the circuit board and the plane formed by loop antenna element and onto a plane formed in parallel with the plane formed by loop antenna element.

The conductor pins of the conductor member stand vertically on the surface of the circuit board and are placed with the equal distances around the tubular insulator member described above and with the equal distances each other, respectively. Each of the conductor pins has a height from the surface of the circuit board up to the position of the above conductor ring and the number of pins is three or more.

The conductor wall of the conductor member is formed on the surface of the circuit board with some space around the cylindrical body or the tubular insulator member in a tubular fashion. The conductor wall has a height of an intermediate or middle distance from the surface of the circuit board up to the plane formed by the loop antenna element.

The loop antenna of this invention has been improved for several times by co-inventors for suppressing the conventional radiation gain onto direction of the central axis, and for increasing gain onto directions in the low angle of the elevation to spread range of the radiation. The improvement is to provide a conductor member placed with some space around the cylindrical body having the loop antenna element and at a predetermined position between the surface of the circuit board and a plane formed by the loop antenna element. As the results, the co-inventors have confirmed that the structure can spread the radiation.

DESCRIPTION OF THE PREFERRED EMBODIMENTS

Now, several preferred embodiments of the present invention will be described with reference to the drawings in detail.

An object of the present invention is to provide a loop antenna which is capable of obtaining the good enough gain in a range of low angles of elevation against a level surface when a central axis of the loop antenna is placed to a vertical direction for the level surface. This object is realized by providing a conductor member placed at a predetermined position between a surface of a circuit board and a plane formed by a loop antenna element with a space around a cylindrical body having the loop antenna element, without much decreasing of gain for a direction to the central axis. In this case, the surface of the circuit board is used being placed on the level surface or the horizontal plane.

First Embodiment

Figure 3:
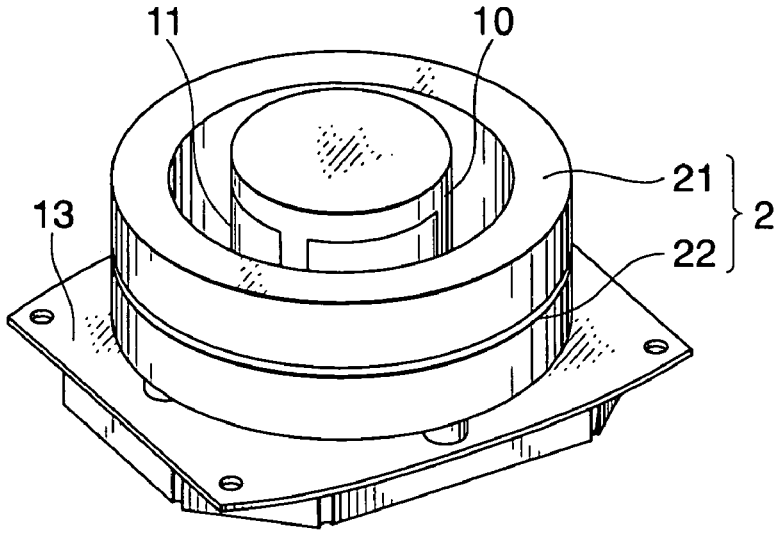
FIG. 3 is a perspective view showing a structure of a loop antenna according to a first embodiment of the present invention.

Referring to FIG. 3, description will be made of a loop antenna according to a first embodiment of the present invention.

FIG. 3 is a perspective view showing a structure of the loop antenna according to the first embodiment of the present invention. In FIG. 3, a loop antenna element 10, a cylindrical body 11, and a circuit board 13 are the same structure elements as shown in FIG. 1.

Figure 1:
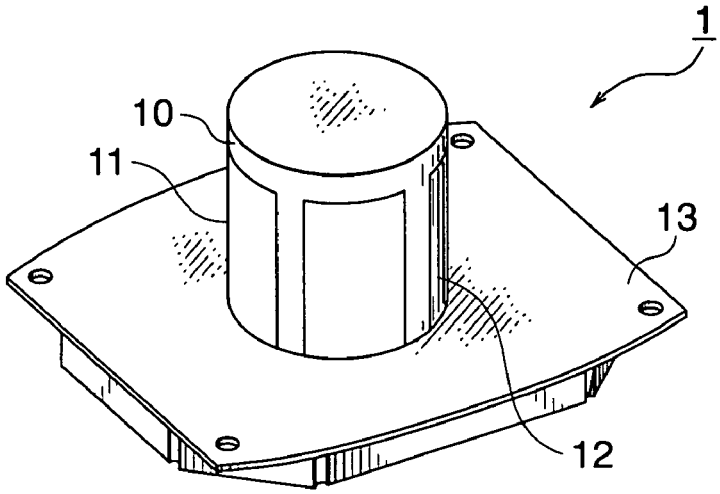
FIG. 1 PRIOR ART
FIG. 1 is a perspective view showing a structure of a conventional loop antenna.

Namely, as shown in FIG. 1, the cylindrical body 11 having an outside diameter of 20 mm and a height of 20 mm is provided on the surface of the circuit board 13, and placing a central axis thereof onto a vertical direction to the surface or a level surface. The loop antenna element 10 is provided around a top peripheral surface of the cylindrical body 11.

The difference point from FIG. 1 is that a ring structure member 2 is provided on the surface of the circuit board 13. The ring structure member 2 consists of a tubular insulator member 21 of ABS resin, for example, as main material and a conductor ring 22. The tubular insulator member 21 is placed around the cylindrical body 11 and has a central axis thereof corresponding to the central axis of the cylindrical body 11. The tubular insulator member 21 has a size of an inside diameter of 35 mm, an outside diameter of 40 mm, and a height of 15 mm. The conductor ring 22 has a width of 1 mm and is placed with a height of 10 mm from the surface of the circuit board 13 on a tubular insulator member 21 along the peripheral surface of the tubular insulator member 21. Inasmuch as the cylindrical body 11 has the outside diameter of 20 mm and the conductor ring 22 has a diameter of 40 mm, there is a space of 10 mm between the cylindrical body 11 and the conductor ring 22.

The ABS resin is generally used for the tubular insulator member 21. This is because the ABS resin has an effect that the radiation is spread to horizontal direction.

Figure 2:
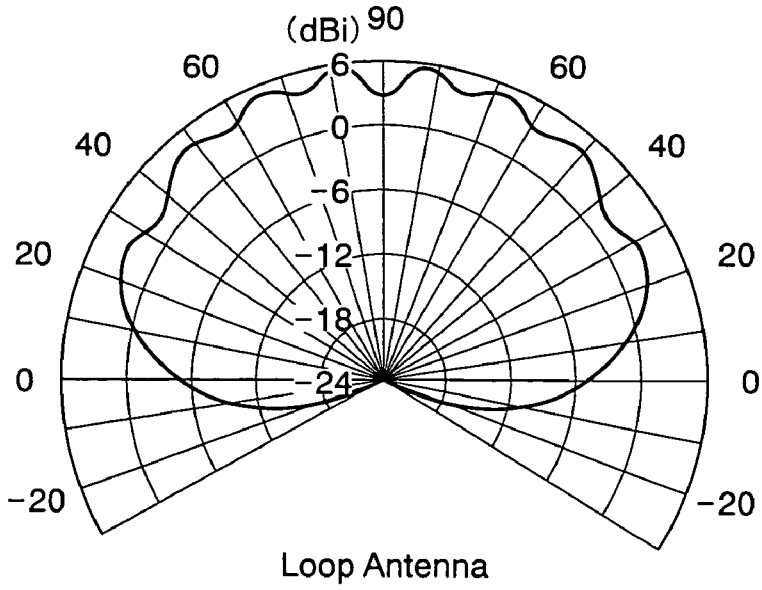
FIG. 2 PRIOR ART
FIG. 2 is a view showing an antenna radiation pattern obtained by the loop antenna shown in FIG. 1.
Figure 4:
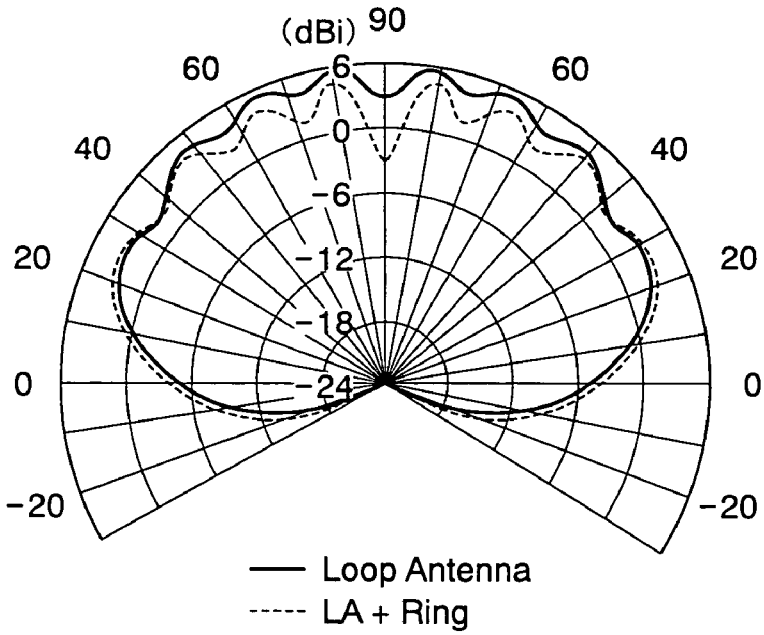
FIG. 4 is a view showing antenna radiation patterns in LHCP (left-hand circular polarization wave) overlapped each other for loop antennas shown in FIGS. 1 and 3.

FIG. 4 shows an antenna radiation pattern of the loop antenna according to the first embodiment in LHCP overlapped onto FIG. 2 described above showing the antenna radiation pattern of the conventional loop antenna therein. As a result of comparison between the loop antenna according to the first embodiment of this invention and the conventional loop antenna in FIGS. 2 and 4, it is appreciated for the loop antenna according to the first embodiment of this invention that effects improving the radiation characteristic within range of low angles of elevation are obtained by adopting the structure with the conductor ring.

It is clear that the actual gain values are varied by relative position between the loop antenna element and the conductor ring. Accordingly, the present invention is not limited to any sizes in the foregoing description.

Second Embodiment

Figure 5:
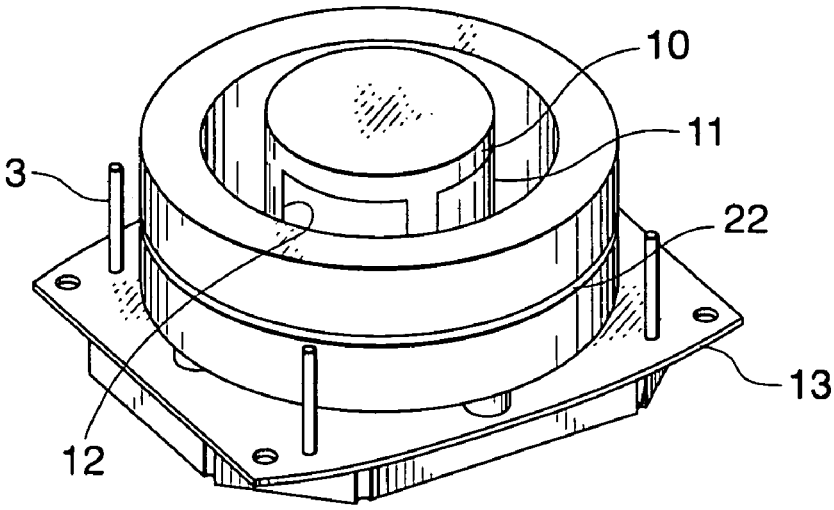
FIG. 5 is a perspective view showing a structure of a loop antenna according to a second embodiment of the present invention.

Referring to FIG. 5, description will be made of a loop antenna according to a second embodiment of the present invention.

FIG. 5 is a perspective view showing a structure of the loop antenna according to the second embodiment of the present invention. A loop antenna element 10, a cylindrical body 11, a circuit board 13, a tubular insulator member 21, and a conductor ring 22 are the same structure elements as shown in FIG. 3, and their sizes are the same as described above.

The difference of the structure of FIG. 5 from FIG. 3 showing the first embodiment is a set of four conductor pins 3. The four conductor pins 3 are provided with the equal distances around the tubular insulator member 21 and with the equal distances each other in parallel, respectively, on circumference with a diameter of 45 mm having a central axis thereof according to a central axis of the tubular insulator member 21. Each of the conductor pins 3 has a height of 10 mm and a diameter of 1 mm. Accordingly, the top of the conductor pins 3 is placed 2.5 mm apart from the conductor ring 22 on a plane formed by the conductor ring 22.

Figure 6:
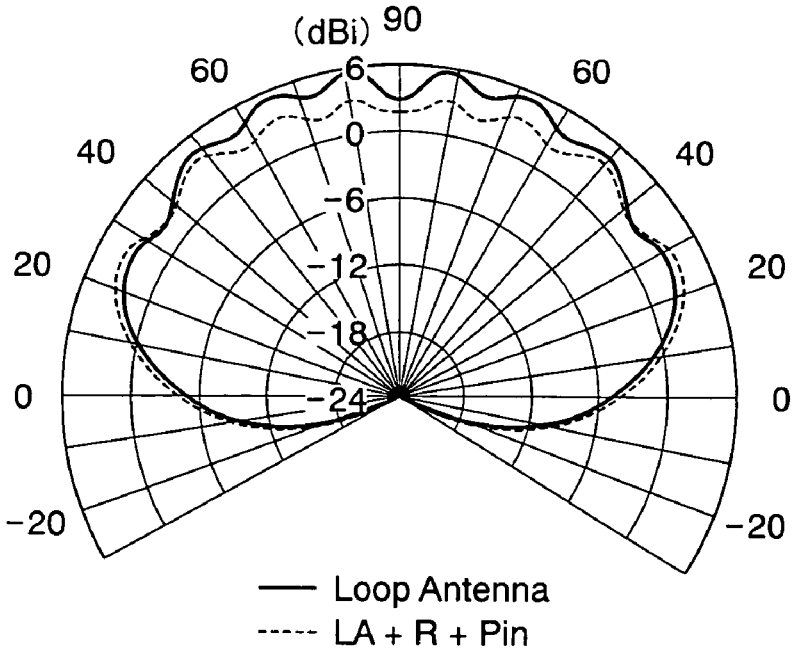
FIG. 6 is a view showing antenna radiation patterns in LHCP overlapped each other for loop antennas shown in FIGS. 1 and 5.

FIG. 6 shows an antenna radiation pattern of the loop antenna according to the second embodiment of this invention in LHCP overlapped onto FIG. 2 described above showing the antenna radiation pattern of the conventional loop antenna therein. As a result of comparison between the loop antenna according to the second embodiment and the conventional loop antenna in FIGS. 2 and 6, it is appreciated for the second embodiment that effects improving the radiation characteristic within range of low angles of elevation are obtained by adopting the structure with the conductor pins. Furthermore, as a result of comparison between the loop antennas according to the first and the second embodiments in FIGS. 4 and 6, it is appreciated that the loop antenna according to the second embodiment of this invention can obtain an effect much improving the radiation characteristic which sharp deteriorated in about 90 degrees of top angle of elevation in the loop antenna according to the first embodiment of this invention. Namely, comparing both the conventional loop antenna with the loop antenna according to the first embodiment of this invention, the loop antenna according to the second embodiment of this invention has effects of improving not only radiation characteristic within range of low angles of elevation but also gains sharp deteriorated in about 90 degrees of top angle of elevation in the loop antenna according to the first embodiment of this invention by adopting the conductor pins.

It is clear that the actual gain values are varied by the number, sizes, or positions of the conductor pins, or mutual position relation among the loop antenna element or the conductor ring and the conductor pins. Accordingly, the present invention is not limited to any conditions in the foregoing description.

Third Embodiment

Figure 7:
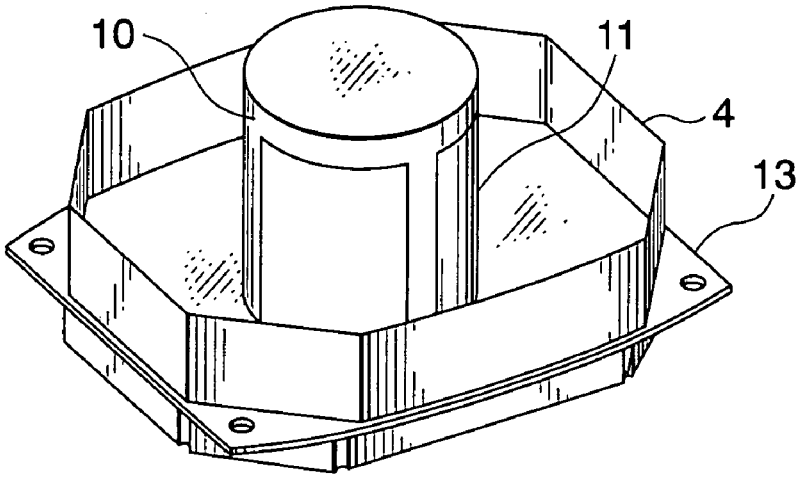
FIG. 7 is a perspective view showing a structure of a loop antenna according to a third embodiment of the present invention.

Referring to FIG. 7, description will be made of a loop antenna according to a third embodiment of the present invention.

FIG. 7 is a perspective view showing a structure of the loop antenna according to the third embodiment of the present invention. A loop antenna element 10, a cylindrical body 11, and a circuit board 13 are the same structure elements as shown in FIG. 1, and their sizes are the same as described above.

Namely, as shown in FIG. 1, the cylindrical body 11 of an outside diameter of 20 mm and a height of 20 mm is provided on the surface of the circuit board 13, and placing a central axis thereof onto a vertical direction to the surface. And for the structure shown in FIG. 1, which the loop antenna element 10 is provided around a top peripheral surface of the cylindrical body 11, a conductor wall 4 is additionally provided in the loop antenna according to the third embodiment of this invention.

The difference from FIG. 1 is that the conductor wall 4 is provided on the surface of the circuit board 13. The conductor wall 4 is placed around the cylindrical body 11 and has a central axis thereof corresponding to the central axis of the cylindrical body 11. The conductor wall 4 has a generally rectangular cross section having a size of about 48 mm long and about 44 mm wide and lacking four corners, and a tubular shape with a height of 10 mm. The conductor wall 4 places the cylindrical body 11 onto center portion thereof and is provided on the surface of the circuit board 13. Such a conductor wall 4 also has the effect that the radiation is spread to horizontal direction, like the ABS resin explained in conjunction with the loop antenna according to the first embodiment of this invention referring to FIG. 3.

Figure 8:
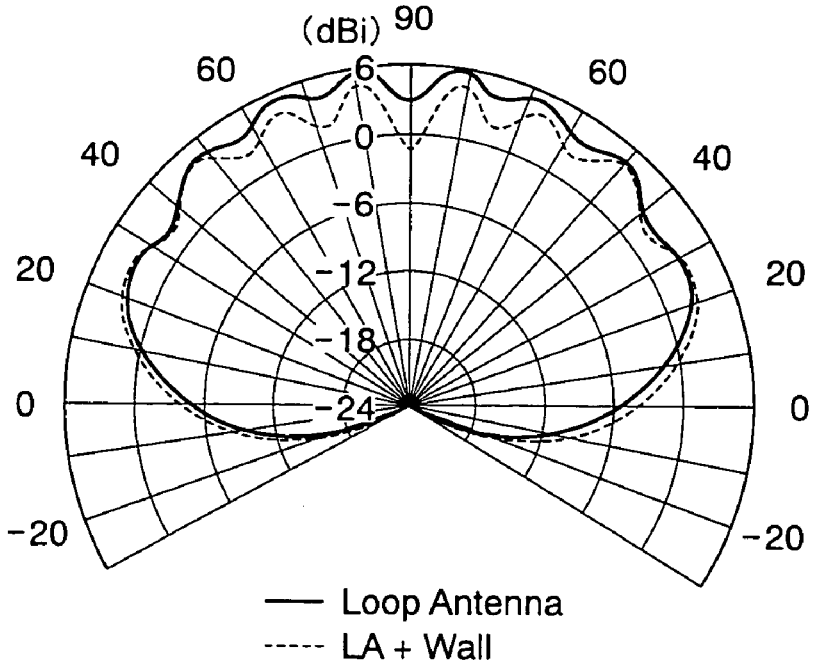
FIG. 8 is a view showing antenna radiation patterns in LHCP overlapped each other for loop antennas shown in FIGS. 1 and 7.

FIG. 8 shows an antenna radiation pattern of the loop antenna according to the third embodiment of this invention in LHCP overlapped onto FIG. 2 described above showing the antenna radiation pattern of the conventional loop antenna therein. As a result of comparison between the loop antenna according to the third embodiment of this invention and the conventional loop antenna in FIG. 8, it is appreciated for the loop antenna according to the third embodiment of this invention that effects improving the radiation characteristic within a range of low angles of elevation are obtained by adopting the structure with the conductor wall. Namely, as compared with the loop antenna according to the first embodiment of this invention, the loop antenna according to the third embodiment of this invention has almost similar effects of improving in the loop antenna according to the first embodiment of this invention by adopting the conductor wall.

It is clear that the actual gain values are varied by the size or the position of the conductor wall, or mutual position relation among the loop antenna element. Accordingly, the present invention is not limited to any conditions in the foregoing description.

Fourth Embodiment

Figure 9:
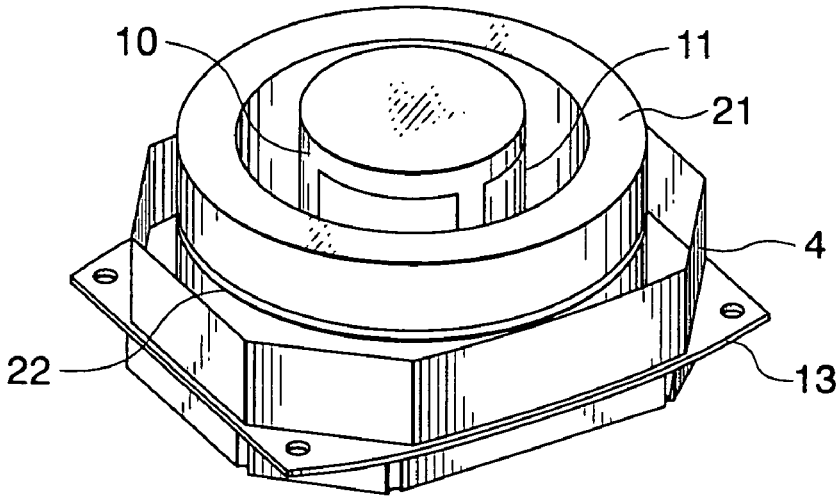
FIG. 9 is a perspective view showing a structure of a loop antenna according to a fourth embodiment of the present invention.
Figure 10A:
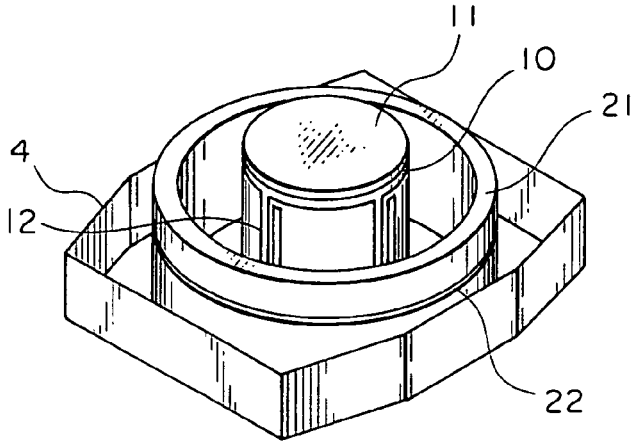
FIG. 10A is a perspective view showing a structure of a loop antenna according to the fourth embodiment of the present invention in case of an actual measurement of a radiation characteristic and an antenna radiation pattern.
Figure 10B:
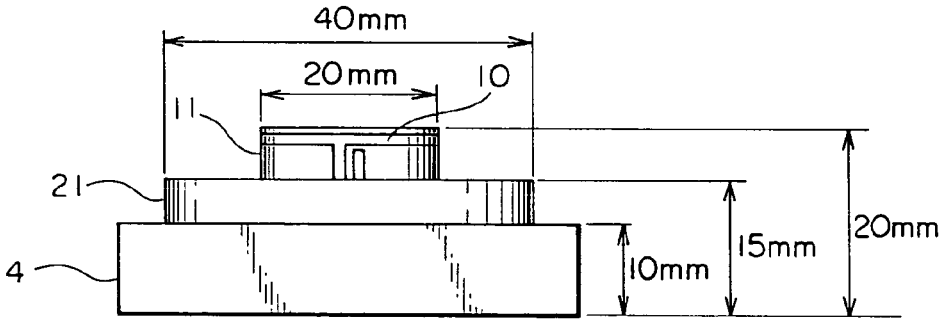
FIG. 10B is a side view showing dimensions of a loop antenna according to the fourth embodiment of the present invention in case of an actual measurement of a radiation characteristic and an antenna radiation pattern.
Figure 10C:
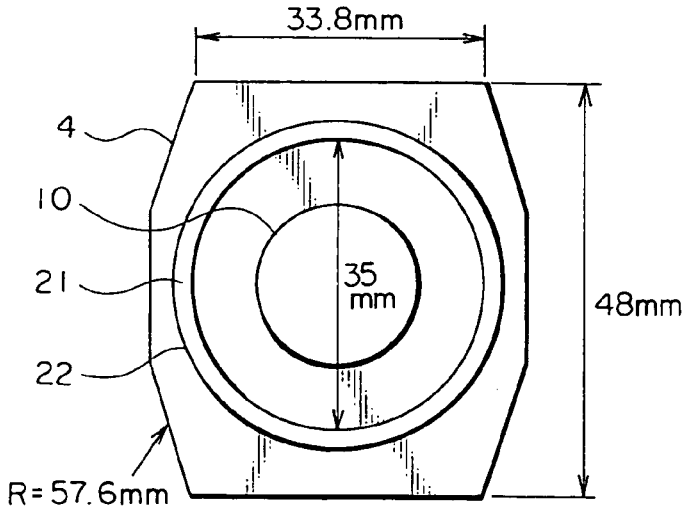
FIG. 10C is a plane plan showing dimensions of a loop antenna according to the fourth embodiment of the present invention in case of an actual measurement of a radiation characteristic and an antenna radiation pattern.

Referring to FIG. 9, description will be made of a loop antenna according to a fourth embodiment of the present invention. The concrete form except the circuit board are shown in FIGS. 10A to 10C. FIG. 10A is a perspective view, FIG. 10B is a side view with sizes, and FIG. 10C is a plane plan with sizes.

FIG. 9 is a perspective view showing a structure of the loop antenna according to the fourth embodiment of the present invention. A loop antenna element 10, a cylindrical body 11, a set of feeders 12, a circuit board 13, a tubular insulator member 21, and a conductor ring 22 are the same structure elements as shown in FIGS. 1 and 3. And their sizes are the same as described above and shown in FIGS. 10A to 10C.

The feeders 12 shown in drawings except FIGS. 10A and 10B are shown such as single feeders because of simplification of the explanation of the loop antenna element 10. However, the set of the feeders 12 shown in FIGS. 10A and 10B is electromagnetic coupling type and actually used in order to obtain data for all embodiments. Namely, all gains shown in radiation characteristics and antenna radiation pattern in FIGS. 2, 4, 6, and 8 are obtained by using the loop antenna element 10 connected with such the electromagnetic coupling type feeders 12. Accordingly, the data for all examples and embodiments are compared by the same condition as for the loop antenna element 10 and the feeders 12.

The difference from FIG. 3 is that the conductor wall 4 is provided on the surface of the circuit board 13. The conductor wall 4 is placed around the tubular insulator member 21 and has a central axis thereof corresponding to the central axis of the cylindrical body 11. The conductor wall 4 has a rectangular like cross section having the same size referring to FIG. 7 and described above. Accordingly, a height of the conductor wall 4 is the almost equal with a position of the conductor ring 22 from the surface of the circuit board 13.

Figure 11:
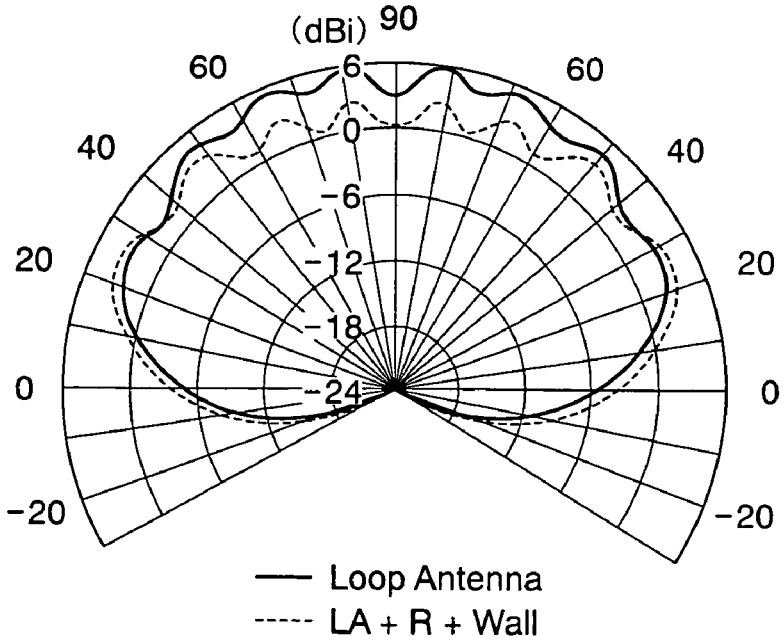
FIG. 11 is a view showing antenna radiation patterns in LHCP overlapped each other for loop antennas shown in FIGS. 1 and 9.

FIG. 11 shows an antenna radiation pattern of the loop antenna according to the fourth embodiment of this invention in LHCP overlapped onto FIG. 2 described above showing the antenna radiation pattern of the conventional loop antenna therein. As a result of comparison between the loop antenna according to the fourth embodiment of this invention and the conventional loop antenna in FIG. 11, it is appreciated for the loop antenna according to the fourth embodiment of this invention that effects of more improving the radiation characteristic within a range of low angles of elevation than the other loop antennas according to the first through the third embodiments are obtained by adopting the structure formed by adding the conductor wall together with the conductor ring.

Furthermore, in the antenna radiation pattern, the loop antenna according to the fourth embodiment of this invention in LHCP shown in FIG. 11 is compared with the loop antenna according to the first embodiment of this invention in FIG. 4 and the loop antenna according to the third embodiment of this invention in FIG. 8 now. As a result, the loop antenna according to the fourth embodiment of this invention can obtain an effect of much improving the radiation characteristic and no sharp deterioration in about 90 degrees of top angle of elevation. Namely, comparing with not only the conventional loop antenna but also the loop antenna according to the first through the third embodiments of this invention, it is appreciated that the loop antenna according to the fourth embodiment of this invention has effects of improving not only radiation characteristic within a range of low angles of elevation but also gains sharp deteriorated in about 90 degrees of top angle of elevation in the first and the third embodiments by adopting the conductor pins or the conductor wall.

[Comparison]

Figures 12, 13:
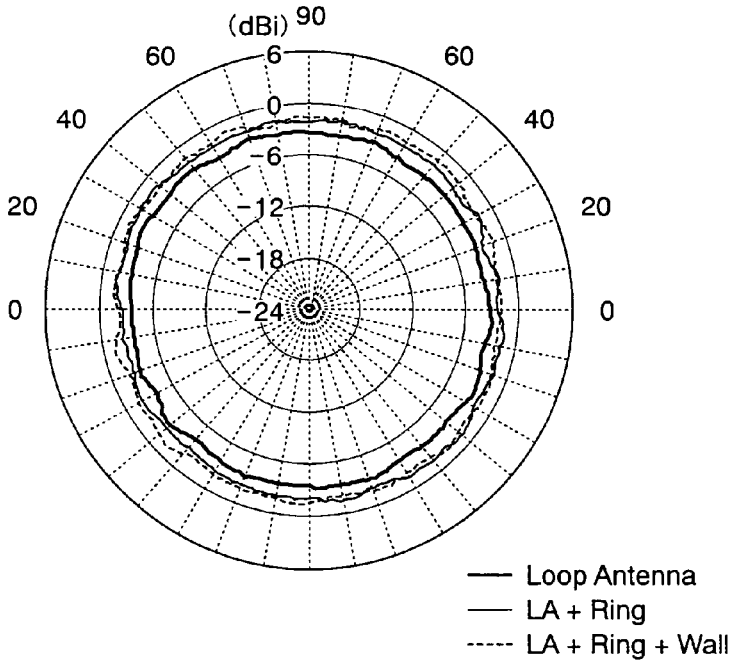
FIG. 12 is a view showing actual measurement values of radiation gains in every five degrees from 20 to 60 degrees of EL.A (angle of elevation) for the conventional loop antenna and loop antennas according to the embodiments of the present invention.
FIG. 13 is a view showing the antenna radiation patterns in TER (terrestrial wave) overlapped each other for the conventional loop antenna and loop antennas according to the embodiments of the present invention.

FIG. 12 shows actual measurement values of radiation gains (dB) in every five degrees from 20 to 60 degrees on angles of elevation (EL.A) for the several structures above-described. The angles of elevation are decided by zero degree of the plane formed by the loop antenna element making a vertical plane to a central axis of the cylindrical body and 90 degrees of the central axis. The actual measurement values are examples shown as results of the actual measuring for conventional structure and the structure of the first to the fourth embodiments of this invention, respectively. Although each of embodiments has been concretely described, it is possible to confirm that values of the gains shown as embodiments of this invention have increased comparing with the conventional ones within 30 degrees on the angles of elevation.

FIG. 13 shows antenna radiation patterns of gains for the conventional loop antenna and the first and the fourth embodiments of this invention respectively. Gains are obtained as the results of measurements in zero degree on the angle of elevation for TER (terrestrial wave) of the frequency 2 GHz band. Namely, the average gains of −3.49 dBi, −2.11 dBi, and −1.75 dBi are shown for examples of the conventional one and the first and the fourth embodiments of this invention respectively, in FIG. 13. Accordingly, it is possible to confirm by the pattern shown in FIG. 13 that gains much increase on the plane formed by the loop antenna element being horizontal or rectangular with the central axis.

Regarding the radiation gains shown in right side (R) and left side (L) columns of FIG. 12, we will compare the conventional loop antenna having only the loop antenna with the loop antenna according to the first embodiment of this invention having the loop antenna and the conductor ring combined with the tubular insulator member of ABS resin. The gains are almost same on about 30 degrees of angle of elevation. However, it is appreciated that the loop antenna according to the first embodiment of this invention has obtained gain effects within a range of 25 degrees or less of low angle of elevation.

The loop antenna characteristic of the loop antenna according to the second embodiment of this invention and a conventional loop antenna are shown by gains (dBi) in FIG. 12. The gains of the loop antenna according to the second embodiment of this invention are almost same as the conventional loop antenna on about 35 degrees of angle of elevation. However, it is appreciated that the second embodiment has obtained gain effects within a range of 30 degrees or less of low angle of elevation comparing with the conventional loop antenna.

The loop antenna characteristic of the loop antenna according to the third embodiment of this invention and a conventional loop antenna are shown by gains (dBi) in FIG. 12. The gains of the loop antenna according to the third embodiment of this invention are almost same as the conventional loop antenna on about 35 degrees of angle of elevation. However, it is appreciated that the loop antenna according to the third embodiment of this invention has obtained gain effects within a range of 35 degrees or less of low angle of elevation comparing with the conventional loop antenna. Namely, the characteristic of the loop antenna according to the third embodiment of this invention is almost same as the characteristic of the loop antenna according to the second embodiment of this invention.

The loop antenna characteristic of the loop antenna according to the fourth embodiment of this invention and a conventional loop antenna are shown by gains (dBi) in FIG. 12. The gains of the loop antenna according to the fourth embodiment of this invention are almost same as the conventional loop antenna on about 35 degrees of angle of elevation. Further, it is appreciated that the loop antenna according to the fourth embodiment of this invention has larger gain effects within a range of 35 degrees or less of low angle of elevation comparing with the conventional loop antenna. Within a range of high angles of elevation, the gains of the loop antenna according to the fourth embodiment of this invention are widely lower than the gains of conventional example. However, electromagnetic waves within a range of high angles of elevation are to have relatively high levels comparing within a range of low angles of elevation or a range of near the level surface. Accordingly, there is no problem for receiving the electromagnetic waves within a range of high angles of elevation.

As appreciated from the characteristic shown in FIGS. 12 and 13, the antenna radiation pattern of the loop antenna according to the fourth embodiment of this invention in TER is improved comparing with ones of other embodiments. The antenna radiation pattern of the loop antenna according to the fourth embodiment of this invention in LHCP is similar to one for the loop antenna according to the second embodiment of this invention shown in FIG. 6.

It is clear that the actual gain values are varied by the size or the position of the conductor wall, or mutual position relation among the loop antenna element or the conductor ring. Accordingly, the present invention is not limited to any conditions in the foregoing description.

The loop antenna according to the present invention can obtain effects much improving the radiation characteristic within a range of low angles of elevation by placing some conductor member(s) on predetermined position(s). The position is determined in intermediate or middle from a surface of a circuit board up to a plane formed by the loop antenna element and has a space around a cylindrical body having a loop antenna element. The conductor member, for example, is a conductor ring, a set of conductor pins, a conductor wall, or the like or a combination thereof. And in case of standing a central axis of the loop antenna onto vertical direction of the level surface or horizontal plane, it is possible to easily obtain good enough gains within a range of low angles of elevation. Accordingly, the present invention is applicable not only to a digital radio receiver of an automobile but also to a receiver using electric wave within a range of low angles of elevation against horizontal plane needs and is indispensable.

What is claimed is:

1. A loop antenna, comprising;

a circuit board having a surface parallel with a level surface;

a cylindrical body which stands on the surface of the circuit board and which is formed by rounding a flexible insulator member around a central axis;

a loop antenna element which is made of a conductor, and which is formed in a loop along a peripheral surface of the cylindrical body around the central axis, on a first plane parallel with and apart from the surface of the circuit board; and a non-feeding conductor member placed around and spaced apart from the cylindrical body at a predetermined position between the surface of the circuit board and the first plane.

2. A loop antenna according to claim 1, further comprising:

a tubular insulator member placed around and spaced apart from the cylindrical body in a cylindrical fashion;

wherein the conductor member comprises a slender conductor ring formed in a loop along a peripheral surface of the tubular insulator member, and said slender conductor ring is positioned at a predetermined intermediate position between the surface of the circuit board and the first plane, on a second plane parallel with the first plane.

3. A loop antenna according to claim 2, wherein said predetermined intermediate position is halfway between the surface of the circuit board and the first plane.

4. A loop antenna according to claim 2, wherein the conductor member further comprises at least three parallel conductor pins placed around the tubular insulator member at equal distances therefrom and with equal distances therebetween, and wherein said at least three conductor pins stand on the surface of the circuit board and have a height measured from the surface of the circuit board that is not higher than the second plane.

5. A loop antenna according to claim 1, wherein the conductor member comprises a conductor wall placed around and spaced apart from the cylindrical body on the surface of the circuit board in a tubular wall fashion, and a top of said conductor wall is at an intermediate position between the surface of the circuit board and the first plane.

6. A loop antenna according to claim 5, wherein the intermediate position is halfway between the surface of the circuit board and the first plane.

7. A loop antenna according to claim 1, further comprising:

a tubular insulator member placed around and spaced apart from the cylindrical body in a cylindrical fashion;

wherein the conductor member comprises:

a slender conductor ring formed in a loop along a peripheral surface of the tubular insulator member, said slender conductor ring being positioned at a predetermined intermediate position between the surface of the circuit board and the first plane, on a second plane parallel with the first plane; and a conductor wall placed around and spaced apart from the tubular insulator member on the surface of the circuit board in a tubular wall fashion, wherein a top of said conductor is at a position between the surface of the circuit board and the second plane.

* * * * *